US008296884B2

(12) United States Patent
Heimbrock

(10) Patent No.: US 8,296,884 B2
(45) Date of Patent: Oct. 30, 2012

(54) SIDERAIL GAP FILLER

(75) Inventor: Richard H. Heimbrock, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 693 days.

(21) Appl. No.: 12/403,645

(22) Filed: Mar. 13, 2009

(65) Prior Publication Data

US 2009/0229050 A1 Sep. 17, 2009

Related U.S. Application Data

(60) Provisional application No. 61/069,272, filed on Mar. 13, 2008.

(51) Int. Cl.
*A47C 21/08* (2006.01)

(52) U.S. Cl. ..... 5/430; 5/428

(58) Field of Classification Search ..... 5/425–430, 5/600

See application file for complete search history.

(56) References Cited

U.S. PATENT DOCUMENTS

| | | | |
|---|---|---|---|
| 421,656 | A | 2/1890 | Blanken |
| 2,136,088 | A | 11/1938 | Stevens, Sr. |
| 2,164,484 | A | 7/1939 | Wolfe |
| 2,556,591 | A | 6/1951 | Loxley |
| 3,220,022 | A | 11/1965 | Nelson |
| 3,742,530 | A | 7/1973 | Clark |
| 4,183,015 | A | 1/1980 | Drew et al. |
| 4,215,446 | A | 8/1980 | Mahoney |
| 4,439,880 | A | 4/1984 | Koncelik et al. |
| 4,453,732 | A | 6/1984 | Assanah et al. |
| D276,112 | S | 10/1984 | Ferrell et al. |
| 4,670,923 | A | 6/1987 | Gabriel et al. |
| 4,710,049 | A | 12/1987 | Chang |
| 4,827,545 | A | 5/1989 | Arp |
| 4,847,929 | A | 7/1989 | Pupovic |
| 4,862,529 | A | 9/1989 | Peck |
| 5,044,025 | A | 9/1991 | Hunsinger et al. |
| 5,077,843 | A | 1/1992 | Dale et al. |
| 5,083,332 | A | 1/1992 | Foster et al. |
| 5,084,925 | A | 2/1992 | Cook |
| 5,097,550 | A | 3/1992 | Marra, Jr. |
| 5,175,897 | A | 1/1993 | Marra, Jr. |
| 5,179,744 | A | 1/1993 | Foster et al. |
| 5,191,663 | A | 3/1993 | Holder et al. |
| 5,381,571 | A | 1/1995 | Gabhart |
| 5,450,641 | A | 9/1995 | Montgomery |
| 5,454,126 | A | 10/1995 | Foster et al. |
| 5,455,973 | A | 10/1995 | Brumfield et al. |
| 5,479,666 | A | 1/1996 | Foster et al. |
| 5,485,699 | A | 1/1996 | Gabhart |
| 5,557,817 | A | 9/1996 | Haddock |
| 5,577,277 | A | 11/1996 | Sundberg et al. |
| 5,671,490 | A | 9/1997 | Wu |
| 5,689,839 | A | 11/1997 | Laganiere et al. |
| 5,715,548 | A | 2/1998 | Weismiller et al. |
| 5,732,423 | A | 3/1998 | Weismiller et al. |
| 5,761,756 | A | 6/1998 | Nowak et al. |
| 5,781,945 | A | 7/1998 | Scherer et al. |
| 5,864,900 | A | 2/1999 | Landau |

(Continued)

*Primary Examiner* — Fredrick Conley
(74) *Attorney, Agent, or Firm* — Barnes & Thornburg LLP

(57) ABSTRACT

A gap-filler for a patient-support apparatus comprises a barrier panel, a first coupler coupled to the barrier panel and a second coupler coupled to the barrier panel and configured to engage a siderail of the patient-support apparatus such that the gap-filler is movable relative to the siderail as the siderail moves between a raised position and a lowered position.

20 Claims, 13 Drawing Sheets

U.S. PATENT DOCUMENTS

| | | | | |
|---|---|---|---|---|
| 5,926,873 | A | 7/1999 | Fountain | |
| 6,427,264 | B1 * | 8/2002 | Metz et al. | 5/425 |
| 6,820,293 | B2 | 11/2004 | Alverson | |
| 6,910,236 | B2 | 6/2005 | Rene | |
| 6,928,673 | B2 | 8/2005 | Risk, Jr. | |
| 6,971,132 | B2 | 12/2005 | Feinsod | |
| 7,028,352 | B2 | 4/2006 | Kramer et al. | |
| 7,073,220 | B2 | 7/2006 | Simmonds et al. | |
| 7,100,222 | B2 | 9/2006 | Metz et al. | |
| 7,107,636 | B2 | 9/2006 | Metz et al. | |
| 7,150,058 | B2 | 12/2006 | Rabska et al. | |
| 7,171,708 | B2 | 2/2007 | Osborne et al. | |
| 7,222,377 | B2 | 5/2007 | Kramer et al. | |
| 7,293,305 | B2 | 11/2007 | Metz et al. | |
| 2007/0180624 | A1 * | 8/2007 | Newkirk et al. | 5/663 |

* cited by examiner

SIDERAIL GAP FILLER

This application claims priority under 35 U.S.C. §119(e) to U.S. Provisional Application Ser. No. 61/069,272, filed Mar. 13, 2008, which is expressly incorporated herein by reference hereto.

BACKGROUND OF THE INVENTION

The present disclosure is related to a patient-support apparatus including barrier elements positioned adjacent to lateral sides of a patient-support surface. More specifically, the present disclosure is related to a patient-support apparatus having a movable gap-filler that follows movement of portions of the patient-support apparatus.

SUMMARY OF THE INVENTION

A patient-support apparatus comprises a frame, a siderail movable relative to the frame, and a gap-filler pivotably coupled to the frame and pivotably coupled to the siderail, a portion of the gap-filler pivoting relative to the frame about a first generally horizontal axis and a generally vertical axis as the siderail moves vertically relative to the frame.

The first generally horizontal axis and the generally vertical axis may be fixed relative to the frame. The gap-filler may be movable relative to the siderail. The gap-filler may be pivotable relative to the siderail. The gap-filler may translate along a portion of the siderail.

The gap-filler may include a first coupler coupled to the frame. The first coupler may be pivotable relative to the frame about the generally vertical axis. The first coupler may include a first portion coupled to the frame and a second portion pivotably coupled to the first portion, the second portion pivotable relative to the first portion.

The gap-filler may further include a barrier panel and the second portion of the first coupler may be coupled to the barrier panel. The gap-filler may include a second coupler coupled to the barrier panel and engaged with the siderail. The second coupler may be releasably engaged with the siderail. The second coupler may move relative to the siderail. The second coupler may pivot relative to the siderail.

In some embodiments, the frame includes an extendable portion movable between a first position and a second position. The siderail may be coupled to the frame such that the extendable portion of the frame is movable relative to the siderail to cause the gap-filler to move relative to the siderail. For example, movement of the extendable portion of the frame relative to the siderail causes the gap-filler to pivot relative to the siderail. Also, movement of the extendable portion of the frame relative to the siderail may cause the gap-filler to translate relative to the siderail. Still yet, movement of the extendable portion of the frame relative to the siderail may cause the gap-filler to pivot relative to the frame.

In some embodiments, the gap-filler may comprise a barrier panel, a first coupler coupled to the panel and a second coupler coupled to the barrier panel and configured to engage a siderail of the patient-support apparatus such that the gap-filler is movable relative to the siderail as the siderail moves between a raised position and a lowered position.

The first coupler may include a stem defining a generally vertical axis, a journal coupled to the stem, and a shaft defining a first generally horizontal axis, the shaft secured to the barrier panel and rotatable within the journal. The stem may be configured to be received in a frame of the patient-support apparatus and to pivot relative thereto.

In some embodiments, the second coupler includes a first portion coupled to the barrier panel and a second portion removably secured to the first portion, the first portion and second portion configured to cooperate to trap at least a portion of the siderail between the first and second portions.

DETAILED DESCRIPTION OF THE DRAWINGS

Figure 1:
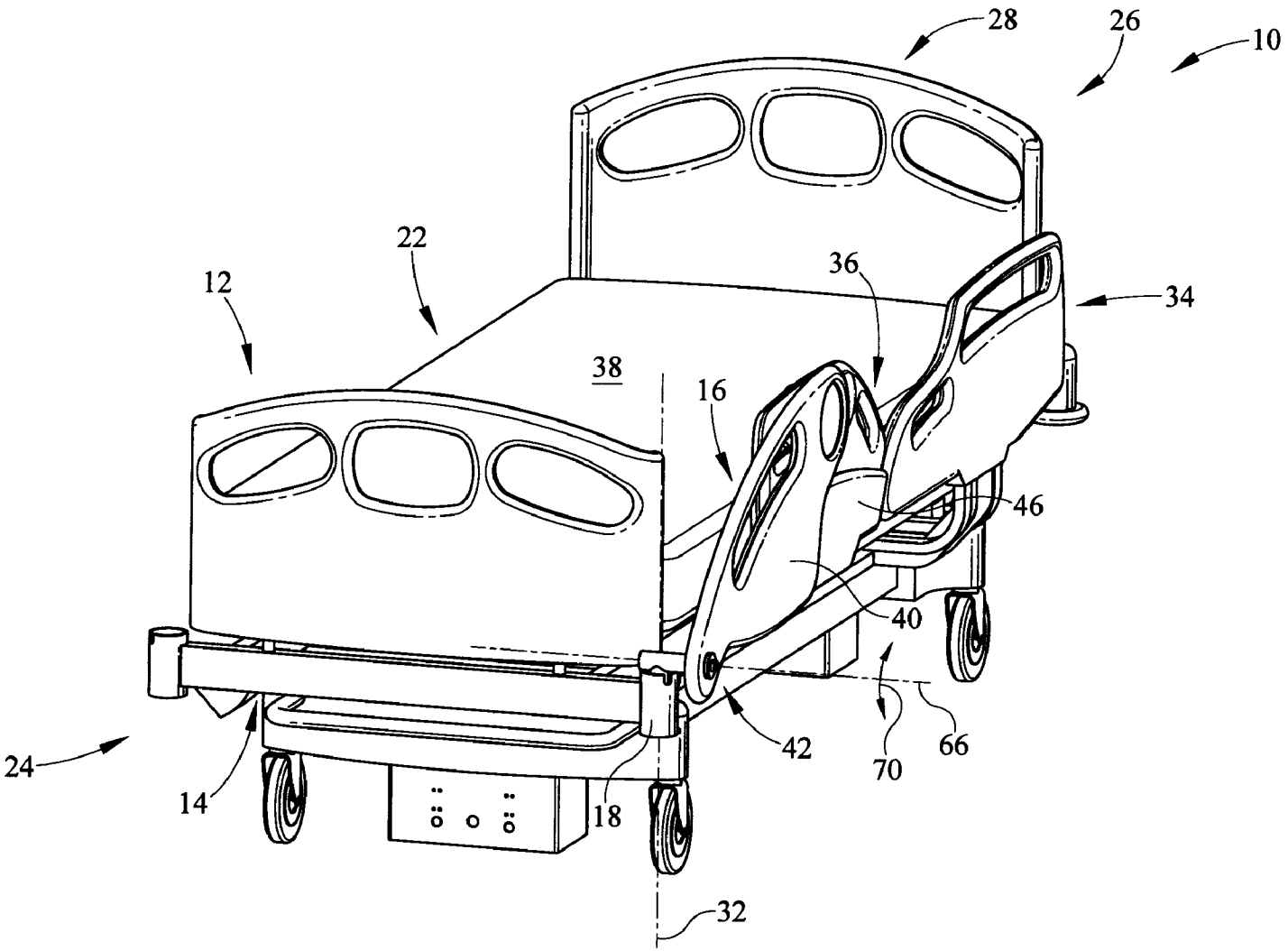
FIG. 1 is perspective view of a patient-support apparatus including a gap-filler positioned between a siderail and a mount supported on a frame of the patient-support apparatus, the siderail in a raised position.

In one illustrative embodiment of the present disclosure, an end panel 12 is mounted on a frame 14 of a patient-support apparatus 10 as shown in FIG. 1. Illustratively, patient-support apparatus 10 is embodied as a hospital bed. Hospital bed 10 is shown in FIG. 1 with a foot end 24 positioned at the lower left side of the figure and a head end 26 at the upper right side of the figure. Typically, a patient occupies hospital bed 10 in a supine position on a patient-support surface 22. Illustratively patient-support surface 22 may be a mattress.

Figure 4:
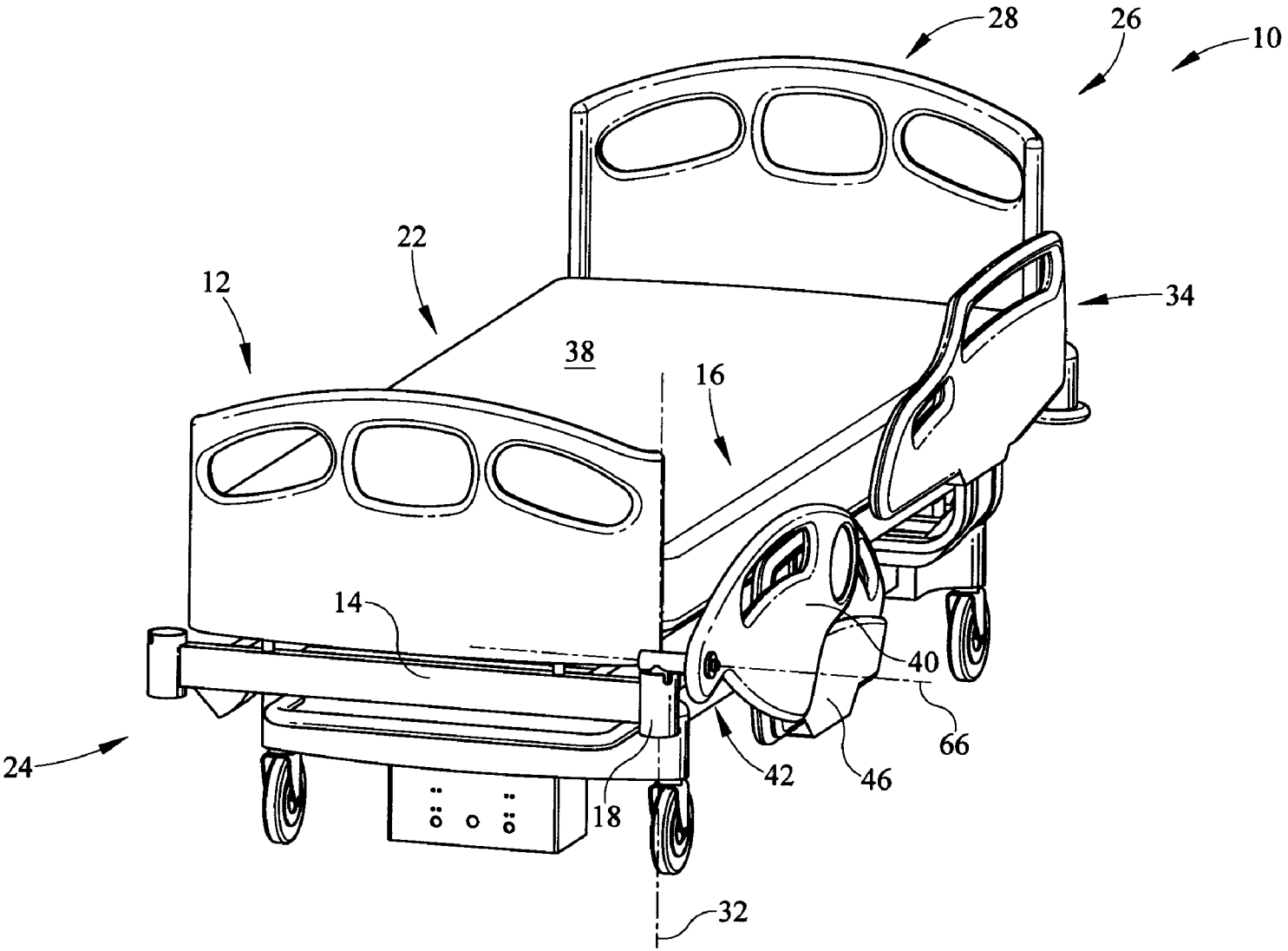
FIG. 4 is perspective view of the patient-support apparatus including a gap-filler positioned between a siderail and a mount supported on a frame of the patient-support apparatus, the siderail in a lowered position.
Figure 5:
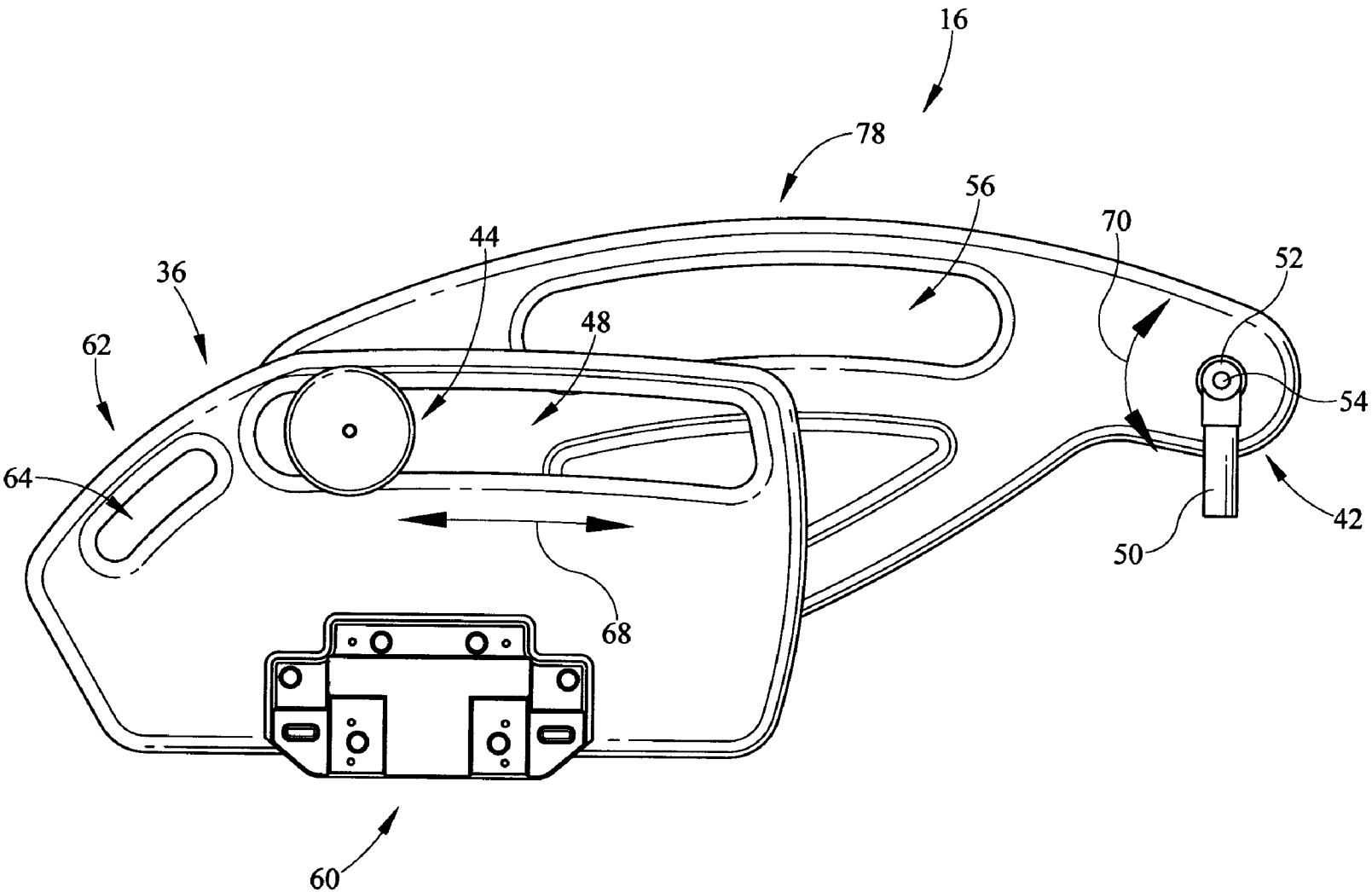
FIG. 5 is the side view of the siderail and gap-filler of FIG. 4, the side view taken from the inboard/mattress side of the patient-support apparatus of FIG. 4.
Figure 6:
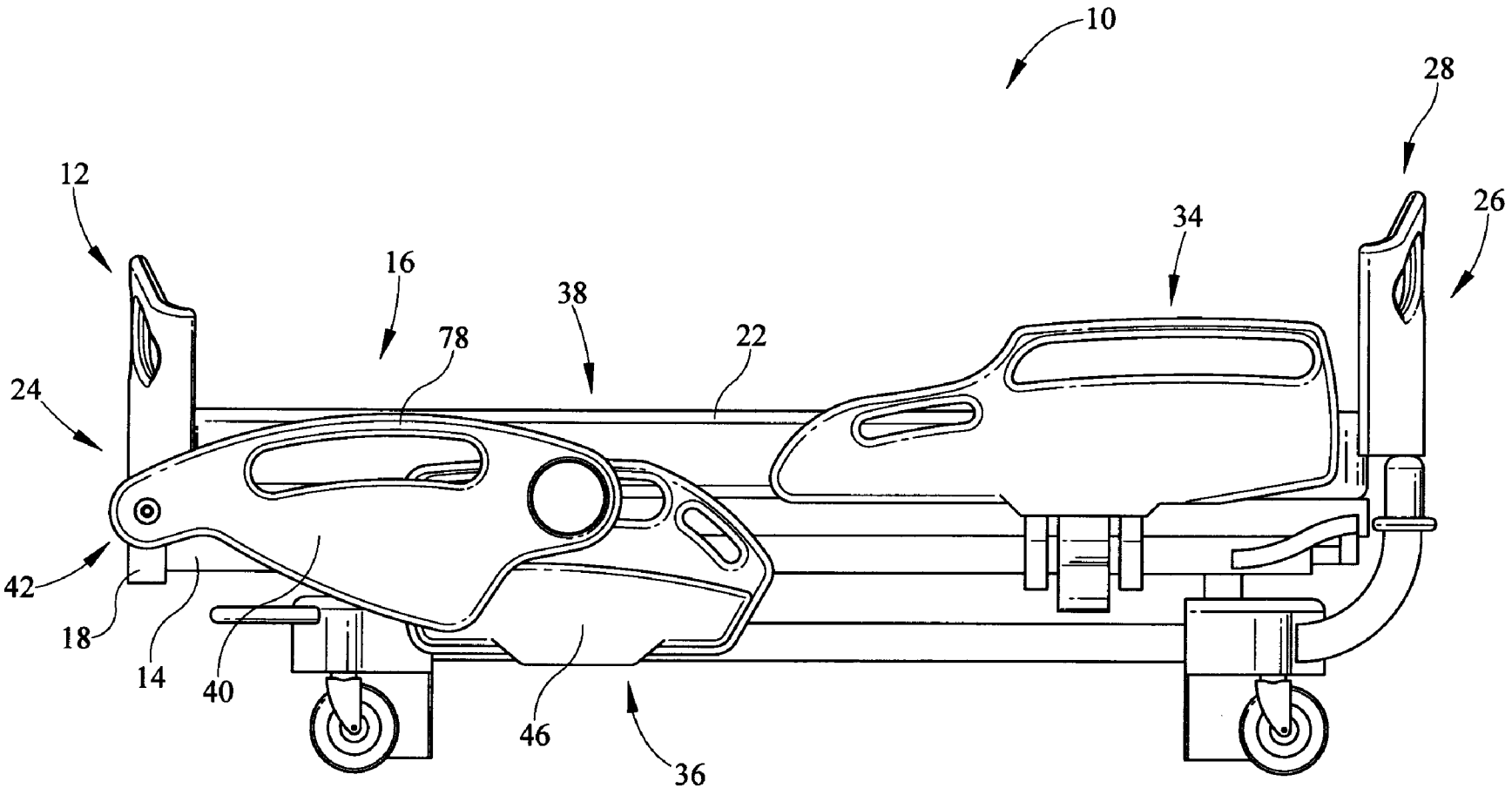
FIG. 6 is a side view of the siderail and gap-filler of FIG. 5, the side view taken from the outboard side of the patient-support apparatus, the side view showing the siderail in the lower position.

When referring to locations on hospital bed 10, the terms "head end" and "foot end" are used generally to provide orientation and do not refer to specific features of the hospital bed 10. The terms "patient left" and "patient right" are used to provide orientation relative to a patient positioned on hospital bed 10 lying in a supine position. As shown in FIG. 1, end panel 12 is oriented at foot end 24 and an end panel 28 is oriented at head end 26. Illustratively, hospital bed 10 further includes four siderails with left and right headrails 34 and left and right siderails 36. A right-hand headrail and a right-hand siderail are similar to headrail 34 and siderail 36 but are not shown in the figures presented. Headrail 34 and siderail 36 are movable between a raised position as shown in FIG. 1 and a lowered position wherein both headrail 34 and siderail 36 are below a top surface 38 of patient-support surface 22. For example, FIGS. 4-6 show siderail 36 in the lowered position.

Figure 11:
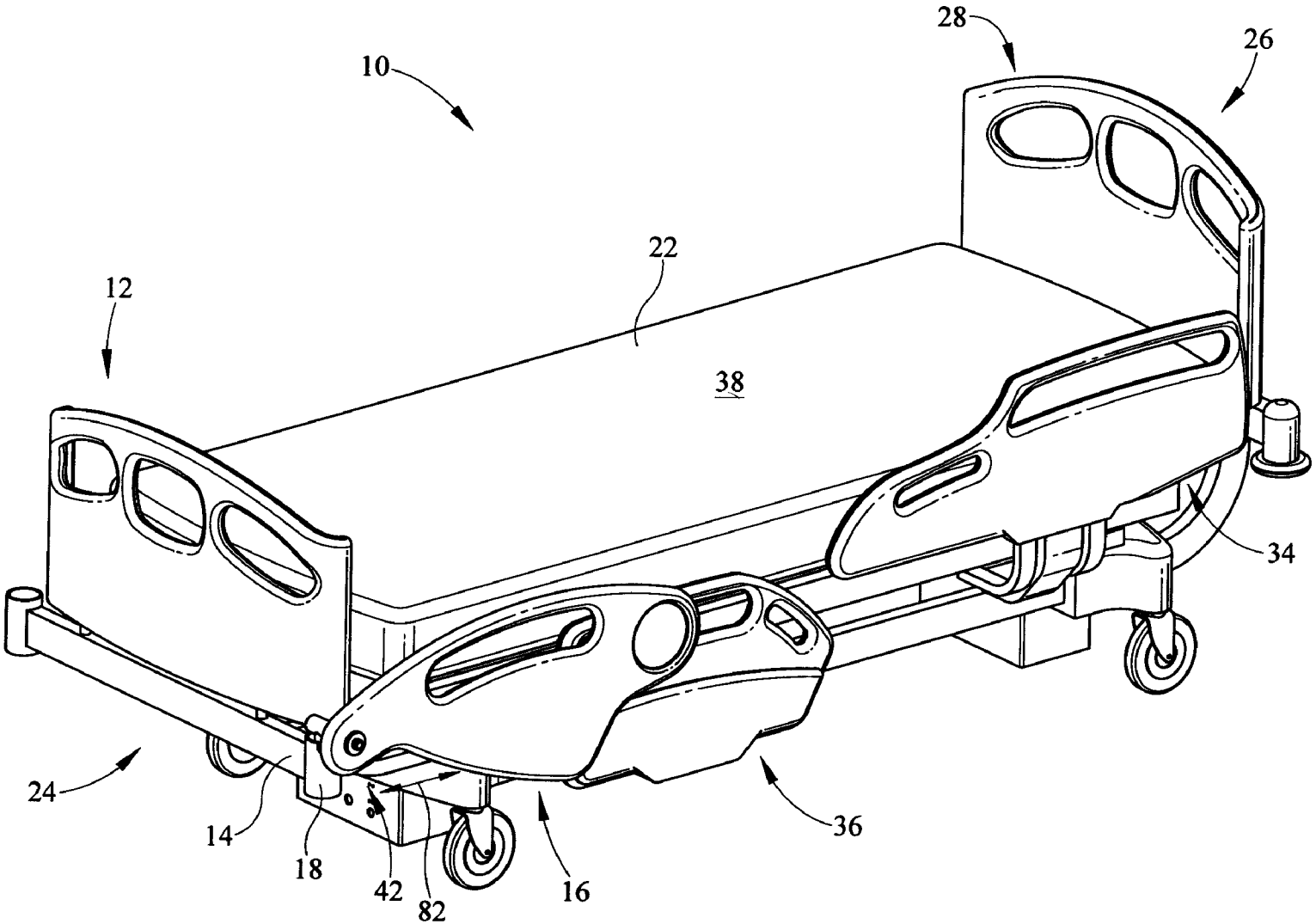
FIG. 11 is another perspective view of the patient-support with the siderail in a lowered position and the gap-filler coupled to the frame and the siderail, an extendable portion of the frame extended relative to another portion of the frame.
Figure 12:
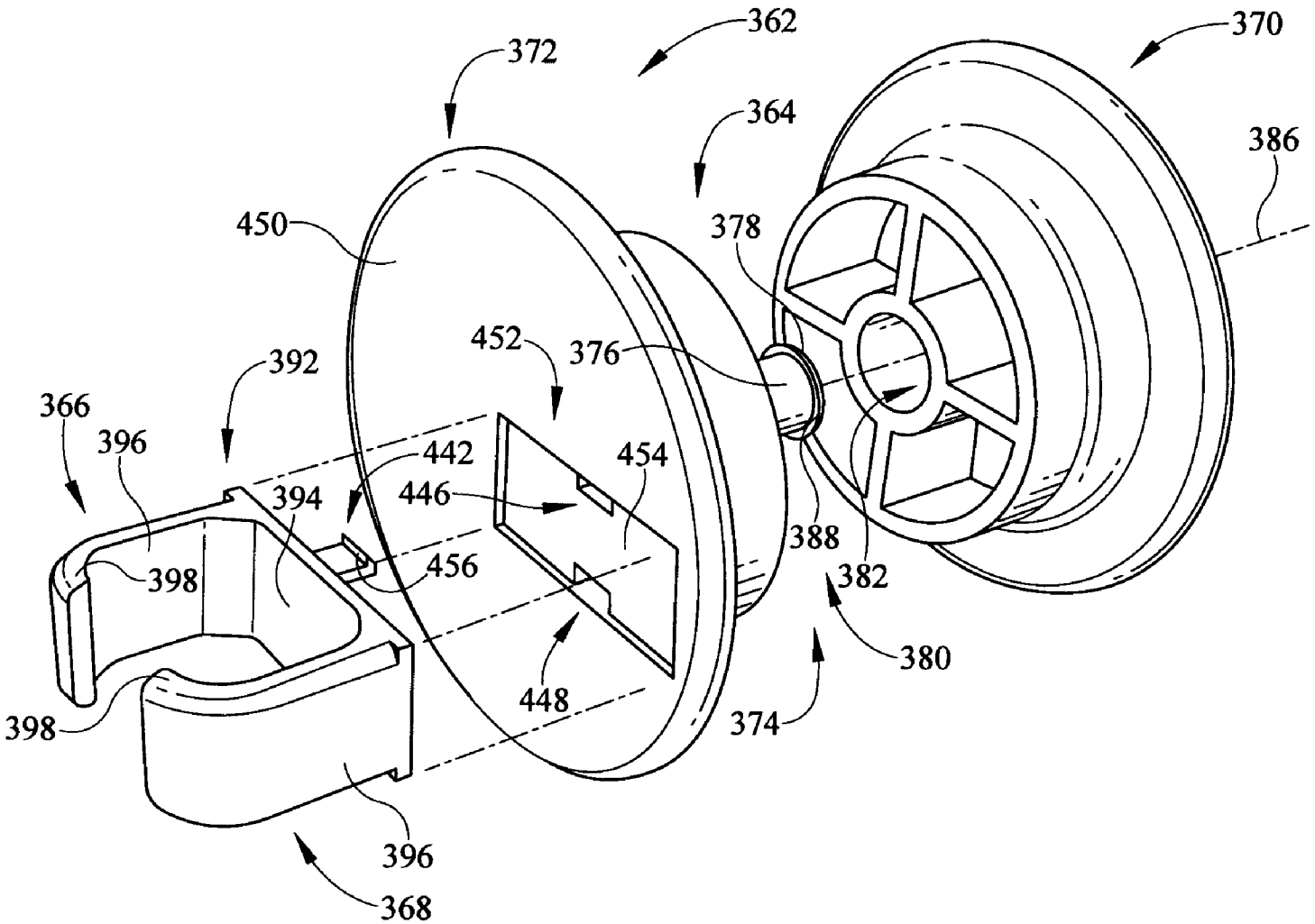
FIG. 12 is an exploded assembly view of a second coupler which couples the gap-filler to the siderail.
Figure 13:
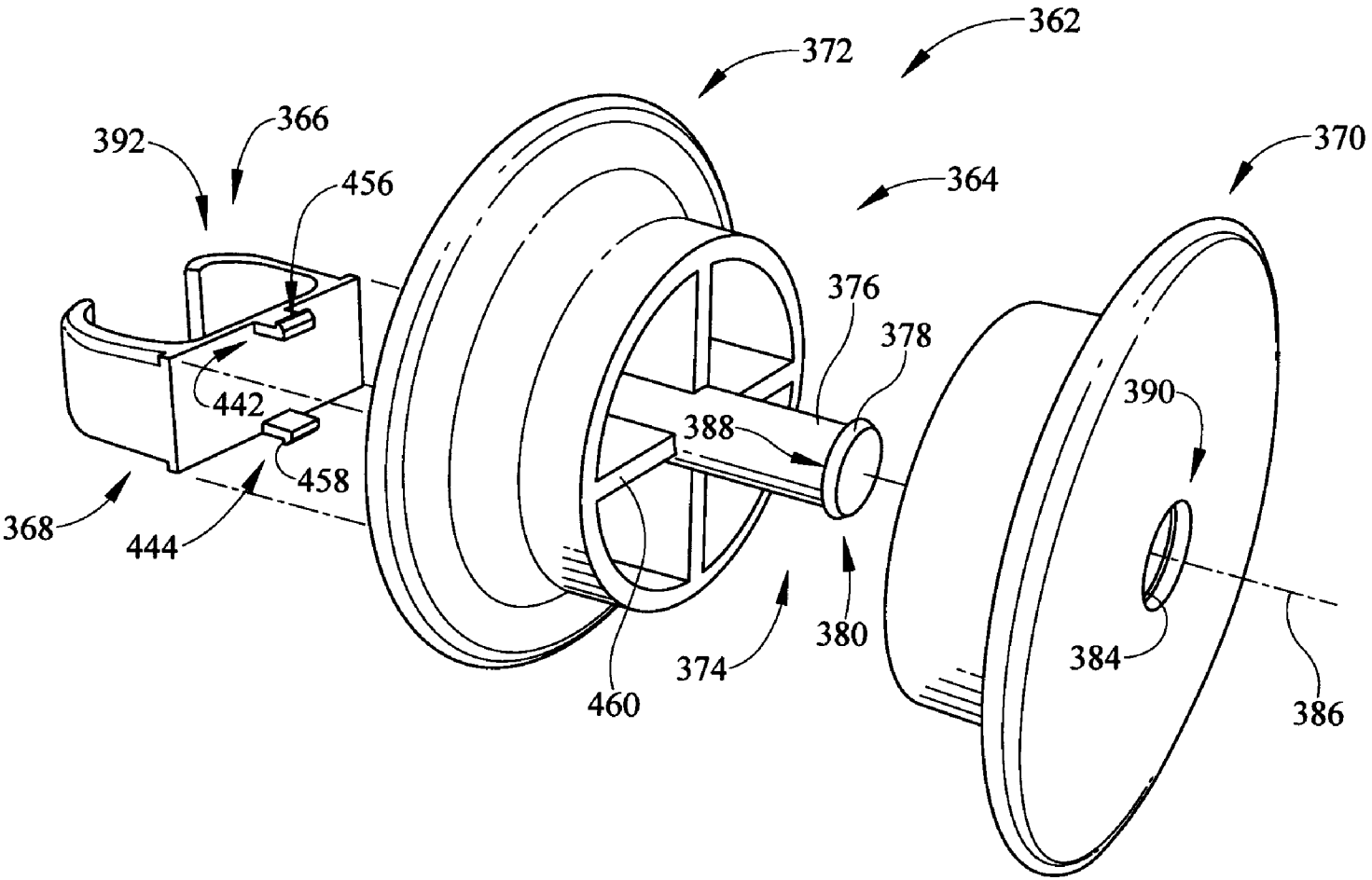
FIG. 13 is another exploded assembly view of the second coupler which couples the gap-filler to the siderail.

Hospital bed 10 further includes a gap-filler 16 coupled to frame 14 and siderail 36. Gap-filler 16 is pivotable relative to frame 14 and is coupled to siderail 36 such that when siderail 36 moves between the raised position and lowered position, gap-filler 16 moves between a raised and a lowered position. Gap-filler 16 provides an additional barrier between siderail 36 and end panel 12. The portion of hospital bed 10 between siderail 36 and end panel 12 is a natural egress point for a patient supported on hospital bed 10. Gap-filler 16 reduces the potential for egress of a patient who is contraindicated for getting out of bed without clinical assistance. In the illustrative embodiment, frame 14 is extendable as suggested by arrow 82 in FIGS. 8 and 11. Gap-filler 16 is movable with the extendable portion of frame 14.

Gap-filler 16 includes a barrier panel 40, a first coupler 42 coupled to barrier panel 40 and configured to engage frame 14. Illustratively first coupler is a frame coupler, but may also be a two-axis coupler. Gap-filler 16 further includes a second coupler coupled to barrier panel 40 and spaced apart from first coupler 42. Second coupler is illustratively shown as a siderail coupler 44, but it should be understood that second coupler 44 is not limited to the illustrated embodiments shown in the figures.

Figure 2:
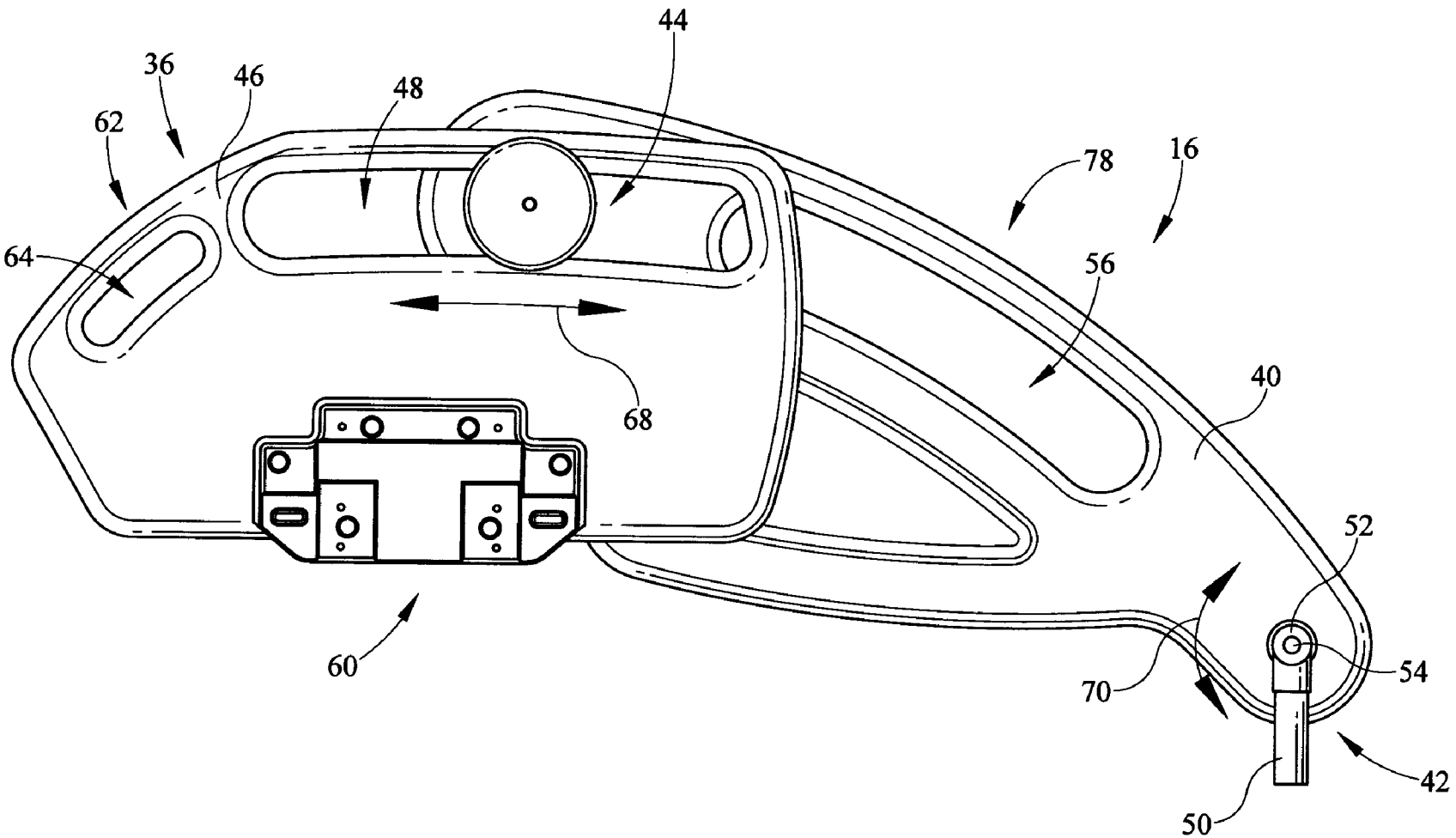
FIG. 2 is a side view of the siderail and the gap-filler of FIG. 1, the side view taken from the inboard/mattress side of the patient-support apparatus of FIG. 1.

Siderail coupler 44 is configured to engage a siderail panel 46 of siderail 36 as shown in FIG. 2. Siderail panel 46 includes a first opening end and a second opening end positioned to in spaced-apart relation to the first opening end. Siderail panel 46 is formed to include an opening 48 defined between first and second opening ends. Siderail coupler 44 is received into opening 48 when gap-filler 16 is coupled to siderail 36. Siderail coupler 44 moves back-and-forth in opening 48 as indicated by arrows 68. Siderail coupler 44 moves relative to siderail panel 46 of siderail 36 when siderail 36 is raised and lowered and when siderail 36 moves relative to frame 14, such as when a deck section to which siderail 36 is coupled moves relative to frame 14 or when an extendable portion of frame 14 extends to increase the distance between end panel 12 and end panel 28 as suggested in FIGS. 8 and 11.

Frame coupler 42 includes a stem 50, a journal 52 coupled to stem 50 and rotatable relative to a shaft 54 which is coupled to barrier panel 40. Frame 14 includes a mount which is illustratively shown as an accessory socket 18 which serves to support various accessories such as IV poles or traction equipment. In the illustrative embodiment of FIG. 1, stem 50 is received in accessory socket 18 and rotates about a generally vertical axis 32 during movement of siderail 36 between the raised and the lowered positions. Illustratively, siderail 36 moves laterally relative to the frame 14 of hospital bed 10 during movement between the raised and lowered positions. During movement of siderail 36 relative to frame 14, shaft 54 rotates within journal 52 about first generally horizontal axis 66 as indicated by arrows 70. Thus, as siderail 36 is moved between a raised position as suggested in FIGS. 1-3 to a lowered position as suggested in FIGS. 4-6, siderail coupler 44 of gap-filler 16 moves along the opening 48 between the position shown in FIG. 2 and the position shown in FIG. 5.

Figure 3:
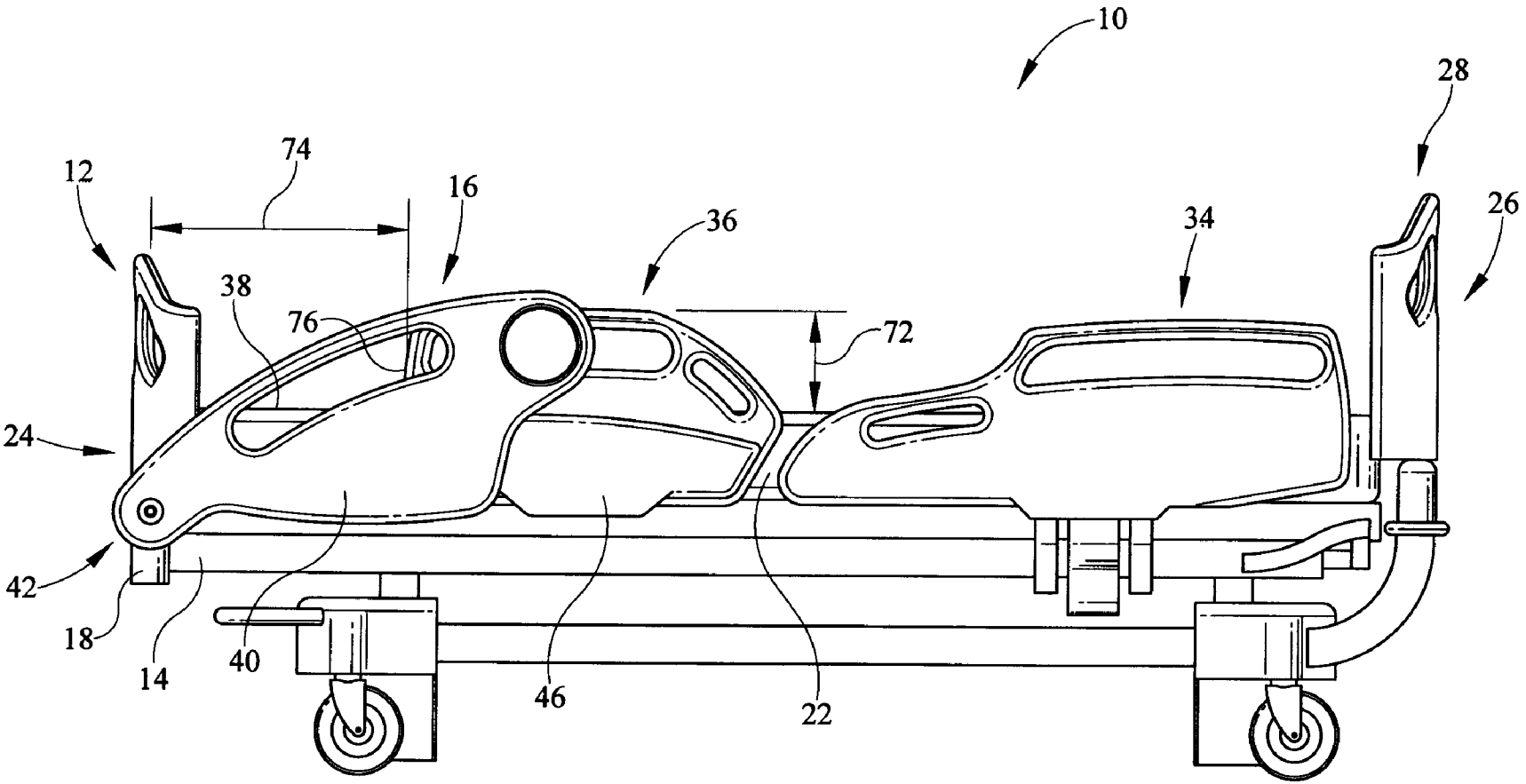
FIG. 3 is a side view of the siderail and gap-filler of FIG. 2, the side view taken from the outboard side of the patient-support apparatus, the side view showing the siderail in the raised position.

Referring now to FIG. 3, when siderail 36 is in a raised position and gap-filler 16 is coupled to siderail 36, siderail 36 and gap-filler 16 extend a distance 72 above top surface 38 of patient-support surface 22. In the raised position, gap-filler 16 occupies a space indicated by arrow 74 in FIG. 3 between a foot end edge 76 of siderail panel 46 of siderail 36 and end panel 12. Referring now to FIG. 6, when siderail 36 is lowered, barrier panel 40 of gap-filler 16 pivots about first generally horizontal axis 66 such that an upper edge of barrier panel 40 is generally vertically below top surface 38 of patient-support surface 22 such that a patient may egress from hospital bed 10.

Siderail panel 46 of siderail 36 is formed to include a grip 62 which may be grasped by a user when positioned on hospital bed 10 or during egress from hospital bed 10. Siderail panel 46 is further formed to include an opening 64 through which a user may insert a portion of their hand when grasping grip 62. Similarly, barrier panel 40 of gap-filler 16 is formed to include a grip 78 which may be grasped by a user during egress from hospital bed 10 when siderail 36 and gap-filler 16 are in the lowered position. Barrier panel 40 is further formed to include an opening 56 through which a user may insert a portion of their hand while grasping grip 78. Siderail 36 is coupled to a portion of hospital bed 10 such as, frame 14 or as shown in the illustrative embodiment, a deck panel 80 which is movable relative to frame 14. Referring now to FIG. 2, a mounting bracket 60 is shown coupled to siderail panel 46 of siderail 36. Mounting bracket 60 is configured to be coupled to a movement mechanism (not shown) which is configured to be coupled to frame 14 or deck panel 80 and allow movement relative thereto.

Figure 7:
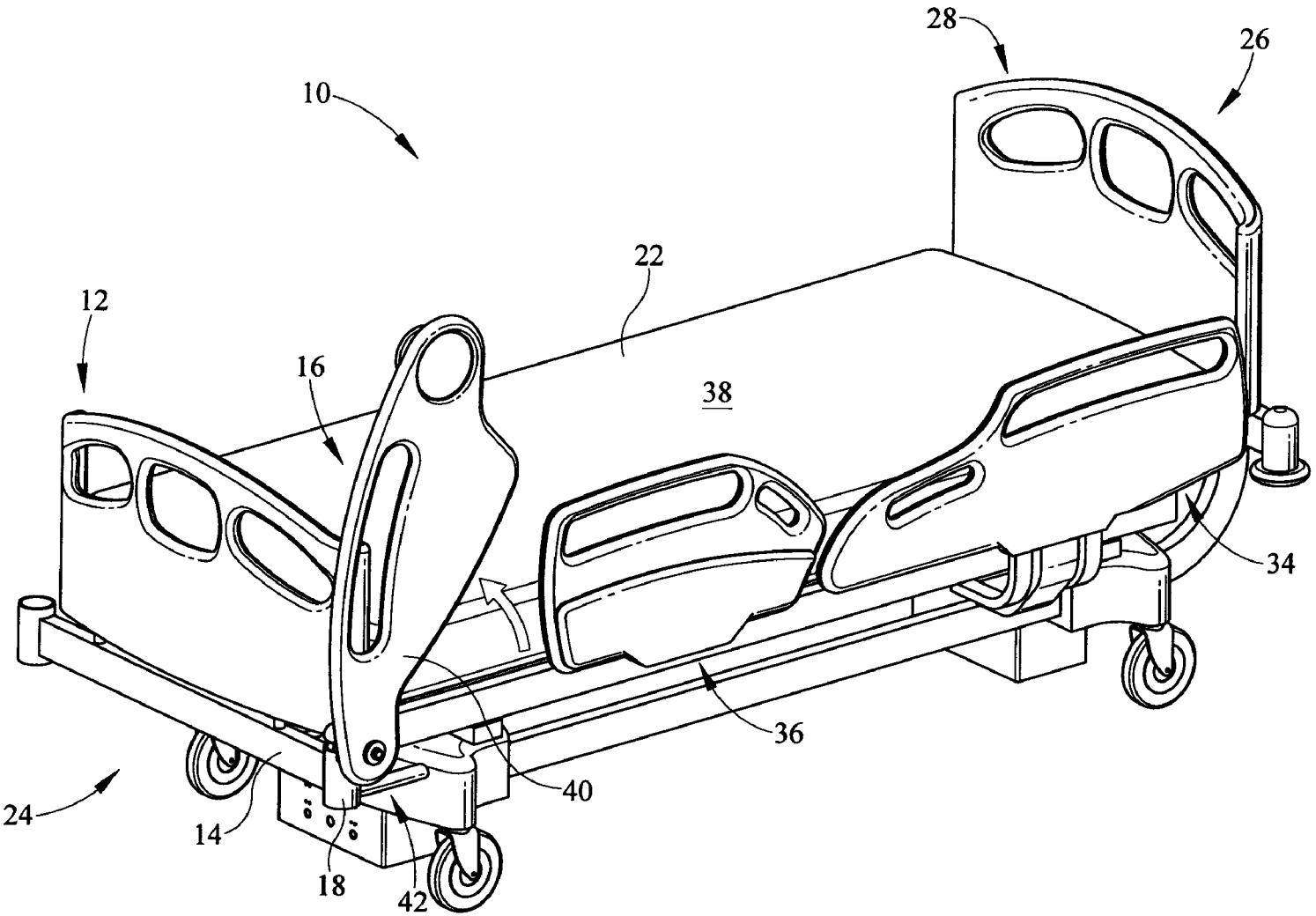
FIG. 7 is a perspective view of the patient-support apparatus with the gap-filler disconnected from the siderail.
Figure 8:
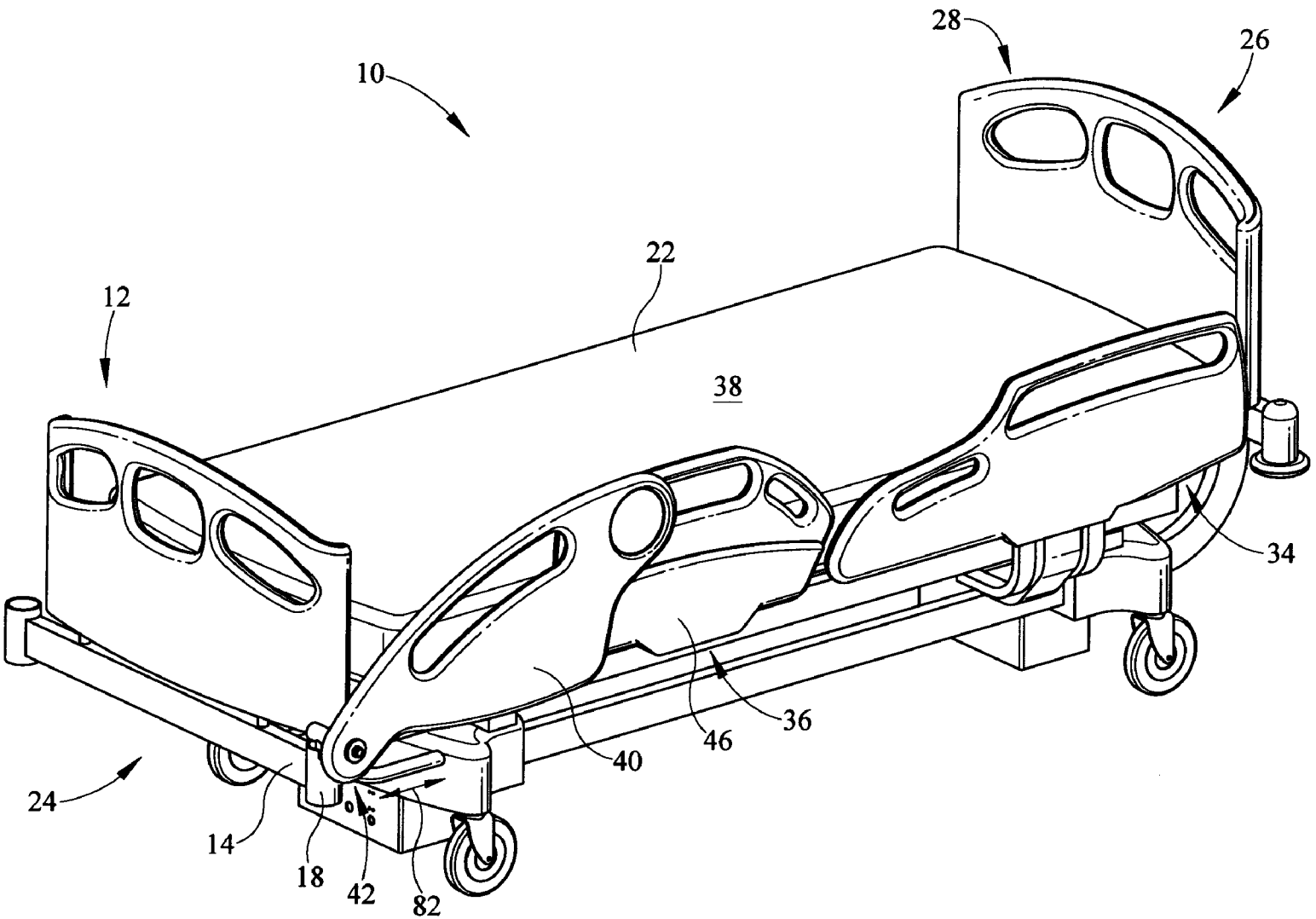
FIG. 8 is a perspective view of the patient-support apparatus with an extendable portion of the frame extended relative to the remainder of the frame, the gap-filler moved relative to the siderail to fill the gap between the end panel and the siderail.
Figure 9:
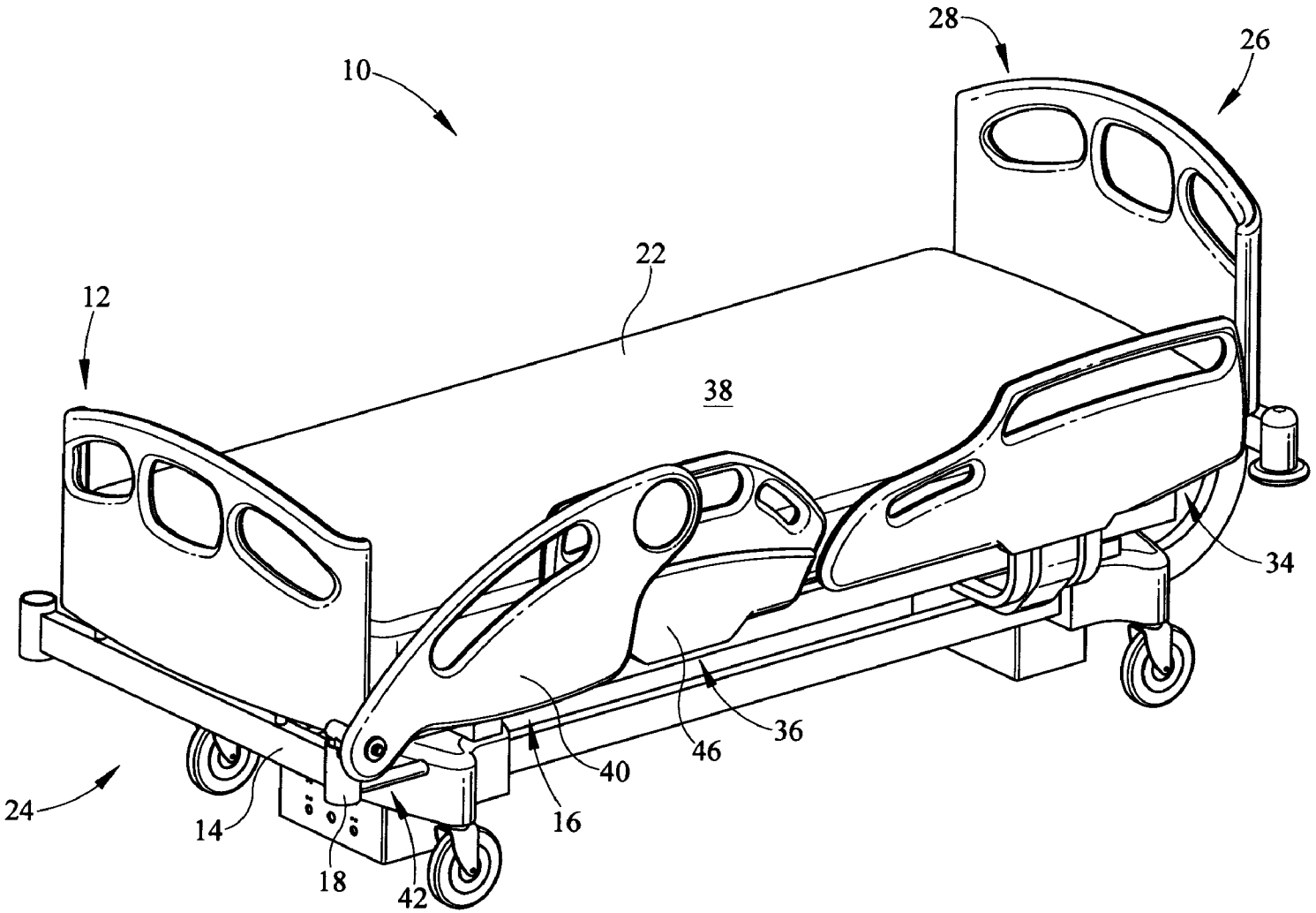
FIG. 9 is another perspective view of the patient-support apparatus with the siderail in a raised position and the gap-filler coupled to the frame and the siderail.
Figure 10:
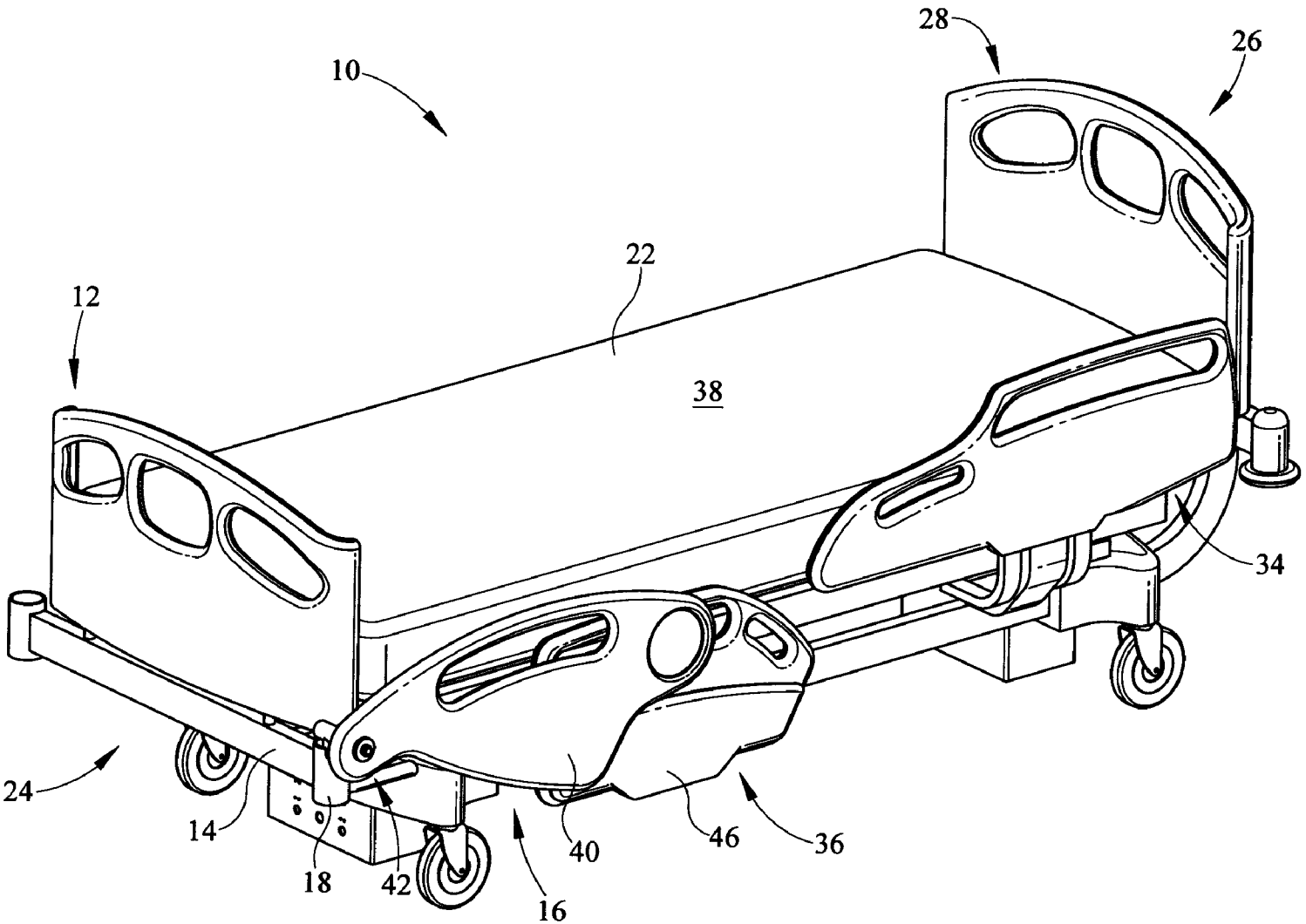
FIG. 10 is another perspective view of the patient-support with the siderail apparatus in a lowered position and the gap-filler coupled to the frame and the siderail.

Siderail coupler 44 illustratively includes an outer portion 370 and an inner portion 372 which are coupled to form body 364 as suggested in FIGS. 7 and 8. Body portions 370 and 372 are secured by a snap-fit between portions thereof. Specifically, body portion 372 is formed to include a stud 374 which includes a cylindrical shaft 376 and an annular flange 378 formed at an end 380 of stud 374. Body portion 370 includes a cylindrical through-hole 382 with an annular surface 384 which is generally perpendicular to a second generally horizontal axis 386 of through-hole 382. Through-hole 382 is sized such that flange 378 deflects when inserted into through-hole 382. When body portion 370 is mated to body portion 372, flange 378 passes through through-hole 382 until flange 378 is received in a cavity 390 formed in an outer surface 392 of body portion 370. When flange 378 is received in cavity 390, flange 378 expands and a surface 388 of flange 378 is engaged with surface 384 such that body portions 370 and 372 are secured together.

Siderail coupler 44 further includes a clamp 392 which includes arms 366 and 368 which are each coupled to a base 394 and extend therefrom. Each arm 366, 368 has a leg 396 and a hook 398 which extends away from leg 396 toward the opposite arm 366 or 368. Clamp 392 is formed such that arms 366 and 368 deflect to permit clamp 392 to grip a portion of barrier panel 40 of gap-filler 16 to secure siderail coupler 44 to gap-filler 16. Arms 366 and 368 comprise illustratively an elastic material.

Clamp 392 is secured to body portion 372 by two tabs 442 and 444 which are sized to be received in two slots 446 and 448 formed in body portion 372. Base 394 is received by a cavity 452 formed in a generally planar surface 450 of body portion 372. Cavity 452 includes a surface 454 which is generally planar a parallel to surface 450. Slots 446 and 448 are formed in surface 450. Tab 442 is formed to include a surface 456. When tab 442 is inserted into slot 452, surface 456 snaps over a surface (not shown) on body portion 372. Similarly, tab 444 is formed to include a surface 458 which snaps over a surface (not shown) when tab 444 is inserted slot 448. Engagement of surfaces 456 and 458 of tabs 442 and 444 with body portion 372 retains clamp 392 on body portion 372. As shown in FIG. 7, clamp 392 is positioned such that it is not centered on second generally horizontal axis 386. This permits tabs 442 and 444 to be inserted through a wall of body portion 372 and clear the rib 460 of body portion 372.

When securing barrier panel 40 of gap-filler 16 to siderail panel 46 of siderail 36, a user separates body portions 370 and 372. Body portion 372 is positioned in opening 48 and body portion 370 is re-attached, trapping siderail panel 46 between body portions 370 and 372. Body portions 370 and 372 are sized such that siderail coupler 44 moves freely within opening 48.

The invention claimed is:

1. A patient-support apparatus comprising a frame including an extendable portion movable between a first position wherein a foot end of the frame is spaced apart from a head end of the frame by a first distance and a second position wherein the foot end is spaced apart from the head end by a second distance greater than the first distance, a siderail supported on the frame and movable relative to the frame between a raised position and a lowered position, the siderail positioned such that the extendable portion of the frame is movable relative to the siderail to vary a distance between a portion of the extendable portion of the frame and the siderail, and wherein a gap defined between the siderail and the portion of the extendable portion of the frame varies, a gap-filler including a barrier panel, and a coupler pivotably coupling the barrier panel to the siderail to move about a generally horizontal axis with the siderail during movement of the siderail between the raised and lowered positions.

2. A patient-support apparatus comprising a frame including an extendable portion movable between a first position wherein a foot end of the frame is spaced apart from a head end of the frame by a first distance and a second position wherein the foot end is spaced apart from the head end by a second distance greater than the first distance, a siderail supported on the frame and movable relative to the frame between a raised position and a lowered position, the siderail positioned such that the extendable portion of the frame is movable relative to the siderail to vary a distance between a portion of the extendable portion of the frame and the siderail, and wherein a gap defined between the siderail and the portion of the extendable portion of the frame varies, a gap-filler including a barrier panel, and coupler means for coupling the barrier panel to the siderail and to the frame to cause the barrier panel to move about a generally horizontal axis and block the gap throughout a range of movement of the extendable portion of the frame and movement of the siderail, wherein the coupler means includes a siderail coupler arranged to interconnect the barrier panel and the siderail and a frame coupler arranged to interconnect the barrier panel and the frame.

3. The patient-support apparatus of claim 2, wherein the siderail includes a siderail panel formed to include an elongated opening configured to receive the siderail coupler and a mounting bracket interconnecting the siderail panel to the frame.

4. The patient-support apparatus of claim 3, wherein the siderail coupler is constrained to move from a first opening end of the elongated opening toward a second opening end of the elongated opening upon movement of the foot end of the frame from the first position toward the second position.

5. The patient-support apparatus of claim 4, wherein the siderail coupler defines a second generally horizontal axis and the barrier panel of the gap-filler is configured to pivot about the second generally horizontal axis upon movement of the siderail between the raised position and the lowered position.

6. The patient-support apparatus of claim 5, wherein the frame coupler includes a stem defining a generally vertical axis, a journal coupled to the stem to move therewith, and a shaft defining a first generally horizontal axis configured to lie in rotative bearing engagement with the journal and the barrier panel is constrained to pivot about the first generally horizontal axis upon movement of the siderail between the raised position and the lowered position.

7. The patient-support apparatus of claim 6, wherein the barrier panel is pivotable about the generally vertical axis of the stem.

8. A patient-support apparatus comprising a frame including an extendable portion movable between a first position wherein a foot end of the frame is spaced apart from a head end of the frame by a first distance and a second position wherein the foot end is spaced apart from the head end by a second distance greater than the first distance, a siderail supported on the frame and movable relative to the frame between a raised position and a lowered position, the siderail positioned such that the extendable portion of the frame is movable relative to the siderail to vary a distance between a portion of the extendable portion of the frame and the siderail, and wherein a gap defined between the siderail and the portion of the extendable portion of the frame varies, a gap-filler including a barrier panel, and coupler means for coupling the barrier panel to the siderail and to the frame to cause the barrier panel to block the gap throughout a range of movement of the extendable portion of the frame and movement of the siderail, wherein the coupler means includes a siderail coupler arranged to interconnect the barrier panel and the siderail and a frame coupler arranged to interconnect the barrier panel and the frame, wherein the frame coupler includes a stem defining a generally vertical axis, a journal coupled to the stem to move therewith, and a shaft defining a first generally horizontal axis configured to lie in rotative bearing engagement with the journal.

9. The patient-support apparatus of claim 8, wherein the siderail coupler includes an outer portion coupled to the barrier panel and arranged to extend toward the siderail and an inner portion coupled removably to the outer portion and the inner portion and the outer portion cooperate to trap at least a portion of the siderail therebetween.

10. The patient-support apparatus of claim 9, wherein the siderail includes a first opening end and a second opening end positioned to lie in spaced-apart relation to the first opening end to define an opening therebetween and the siderail coupler is arranged to extend through the opening to couple the barrier panel of the gap-filler to the siderail so that the barrier panel can move relative to the siderail as the siderail coupler moves in the opening in the siderail.

11. A gap-filler for a patient-support apparatus, the gap-filler comprising a barrier panel, a two-axis coupler secured to the barrier panel and configured to be received in a mount of the patient-support apparatus to allow the barrier panel to pivot about two axes relative to the patient-support apparatus, and a siderail coupler arranged to interconnect the barrier panel and a siderail of the patient-support apparatus to allow the barrier panel to move about a generally horizontal axis in response to movement of the siderail between a raised position and a lowered position.

12. A gap-filler for a patient-support apparatus, the gap-filler comprising a barrier panel, a two-axis coupler secured to the barrier panel and configured to be received in a mount of the patient-support apparatus to allow the barrier panel to pivot about two axes relative to the patient-support apparatus, and a siderail coupler arranged to interconnect the barrier panel and a siderail of the patient-support apparatus to allow the barrier panel to move about a generally horizontal axis in response to movement of the siderail between a raised position and a lowered position, wherein the two-axis coupler includes a stem defining a generally vertical axis, a journal coupled to the stem to move therewith, and a shaft defining a first generally horizontal axis, the shaft coupled to the barrier panel and mounted within the journal for rotation about the first generally horizontal axis relative to the journal.

13. The gap-filler of claim 12, wherein the siderail coupler includes an outer portion coupled to the barrier panel, a cylindrical shaft defining a second generally horizontal axis appended to the outer portion, the cylindrical shaft arranged to extend toward the siderail, and an inner portion removably coupled to the cylindrical shaft.

14. The gap-filler of claim 13, wherein the siderail defines an elongated opening configured to receive the siderail coupler and the siderail coupler is configured to engage a portion of the siderail between the inner portion and the outer portion.

15. The gap-filler of claim 14, wherein the barrier panel is arranged to pivot about both the first generally horizontal axis and the second generally horizontal axis upon movement of the siderail between the raised position and the lowered position.

16. The gap-filler of claim 12, wherein the stem is received in the mount on the patient-support apparatus to cause the barrier panel to rotate about the generally vertical axis during movement of the siderail between the raised and lowered positions.

17. The gap-filler of claim 16, wherein the shaft of the two-axis coupler is mounted within the journal to allow the barrier panel to rotate about the first generally horizontal axis relative to the patient-support apparatus during movement of the siderail between the raised and lowered positions.

18. The gap-filler of claim 17, wherein the siderail coupler is mountable on the siderail to allow the barrier panel to rotate about a second generally horizontal axis.

19. The gap-filler of claim 18, wherein the barrier panel is translatable relative to the siderail.

20. A patient-support apparatus comprising a frame including an extendable portion movable between a first position wherein a foot end of the frame is spaced apart from a head end of the frame by a first distance and a second position wherein the foot end is spaced apart from the head end by a second distance greater than the first distance, a siderail supported on the frame and movable relative to the frame between a raised position and a lowered position, the siderail positioned such that the extendable portion of the frame is movable relative to the siderail to vary a distance between a portion of the extendable portion of the frame and the siderail, and wherein a gap defined between the siderail and the portion of the extendable portion of the frame varies, and a gap-filler including a barrier panel, (i) a frame coupler arranged to interconnect the barrier panel to the extendable portion of the frame for pivotable movement relative to the extendable portion about a first generally horizontal axis and a generally vertical axis, and (ii) a siderail coupler arranged to interconnect the barrier panel to the siderail to cause the barrier panel to pivot about a second generally horizontal axis and to translate relative to the siderail.

* * * * *